US010952309B2

(12) United States Patent
Shields

(10) Patent No.: US 10,952,309 B2
(45) Date of Patent: Mar. 16, 2021

(54) PLASMA TREATMENT HEADS

(71) Applicant: Hewlett-Packard Development Company, L.P., Fort Collins, CO (US)

(72) Inventor: James P. Shields, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 172 days.

(21) Appl. No.: 16/092,932

(22) PCT Filed: Jul. 19, 2016

(86) PCT No.: PCT/US2016/042967
§ 371 (c)(1),
(2) Date: Oct. 11, 2018

(87) PCT Pub. No.: WO2018/017063
PCT Pub. Date: Jan. 25, 2018

(65) Prior Publication Data

US 2019/0174617 A1 Jun. 6, 2019

(51) Int. Cl.
*H05B 7/06* (2006.01)
*H05B 7/08* (2006.01)
(Continued)

(52) U.S. Cl.
CPC ..... *H05H 1/42* (2013.01); *B41J 2/435* (2013.01); *H05H 1/2406* (2013.01);
(Continued)

(58) Field of Classification Search
CPC ..... H05B 7/06; H05B 7/08; H05B 7/18; B41J 11/0015; B41J 2/01–02
See application file for complete search history.

(56) References Cited

U.S. PATENT DOCUMENTS 5,804,360 A 9/1998 Schell et al.
5,963,230 A 10/1999 Higashino et al.
(Continued)

FOREIGN PATENT DOCUMENTS

DE 4342643 3/1995
EP 2279801 2/2011
(Continued)

OTHER PUBLICATIONS

Pykonen et al., Effects of Atmospheric Pressure Plasma Activation on Inkjet Print Quality, Society for Imaging and Technology, NIP23 and Digital Fabrication, 2007, pp. 404-409.
(Continued)

*Primary Examiner* — Michael A Laflame, Jr.
(74) *Attorney, Agent, or Firm* — Thorpe North & Western LLP

(57) ABSTRACT

The present disclosure is drawn to plasma treatment heads. In one example, a plasma head can include a dielectric barrier formed of a dielectric material. The dielectric barrier can have a treatment surface and an interior surface opposite of the treatment surface. A first electrode can be embedded within the dielectric barrier beneath the treatment surface. A second electrode can also be embedded within the dielectric barrier beneath the treatment surface and spaced laterally apart from the first electrode. A plurality of injection holes can penetrate through the dielectric plate from the interior surface to the treatment surface. The plurality of injection holes can be located between the first electrode and second electrode.

16 Claims, 6 Drawing Sheets

(51) Int. Cl.

| | |
|---|---|
| ***B41J 2/01*** | (2006.01) |
| ***B41J 2/02*** | (2006.01) |
| ***H05H 1/42*** | (2006.01) |
| ***H05H 1/24*** | (2006.01) |
| ***B41J 2/435*** | (2006.01) |

(52) U.S. Cl.
CPC ..... *H05H 2001/2418* (2013.01); *H05H 2001/2437* (2013.01); *H05H 2001/2443* (2013.01)

(56) References Cited

U.S. PATENT DOCUMENTS 6,664,737 B1* 12/2003 Berry ..... H01J 37/32009 134/1.1
6,800,342 B2 10/2004 Romano et al.
6,873,052 B2 3/2005 Aoi
7,150,901 B2 12/2006 Campbell et al.
7,167,193 B2 1/2007 Goetzke et al.
7,387,352 B2 6/2008 Florence et al.
7,455,891 B2 11/2008 Kanz et al.
7,758,178 B2 7/2010 Saitoh et al.
8,110,031 B2 2/2012 Zhu et al.
8,186,823 B2 5/2012 Saitoh et al.
8,236,385 B2 8/2012 Yahiaoui et al.
8,287,116 B2* 10/2012 Cofler ..... B41J 3/28 347/101
8,747,969 B2 6/2014 Lu
8,816,211 B2 8/2014 Shukla
8,967,784 B2 3/2015 Ram et al.
8,985,758 B2 3/2015 Mettu et al.
9,034,953 B2 5/2015 Zhou
9,108,437 B2 8/2015 Hirose et al.
9,259,941 B2 2/2016 Watanabe et al.
9,278,548 B2 3/2016 Matsumoto et al.
9,376,582 B1 6/2016 Dannhauser et al.
2002/0097295 A1* 7/2002 Toda ..... B41J 2/1623 347/45
2003/0104140 A1 6/2003 Goodwin et al.
2005/0069655 A1 3/2005 Yamamoto et al.
2005/0129859 A1 6/2005 Misev et al.
2006/0003150 A1 1/2006 Braverman et al.
2006/0022606 A1 2/2006 DeVries et al.
2006/0257681 A1 11/2006 Wolf et al.
2007/0085041 A1* 4/2007 Hisanobu ..... B41J 2/0458 250/504 R
2007/0159517 A1 7/2007 Hashimoto et al.
2007/0166479 A1 7/2007 Drake et al.
2007/0202270 A1 8/2007 Rose et al.
2010/0028561 A1 2/2010 Dubreuil et al.
2010/0304159 A1* 12/2010 Sato ..... C08G 77/38 428/448
2011/0214828 A1 9/2011 Le Loarer
2012/0141180 A1 7/2012 Song et al.
2013/0048601 A1 2/2013 Dryer et al.
2013/0127969 A1* 5/2013 De Schamphelaere ..... G03G 15/323 347/125
2013/0202861 A1 8/2013 Ohta
2013/0224450 A1 8/2013 Wingkono et al.
2013/0260055 A1 10/2013 Shukla
2013/0278689 A1 10/2013 Sowinski et al.
2014/0063154 A1* 3/2014 Gould ..... B41M 7/0081 347/96
2014/0078212 A1 3/2014 Nakai et al.
2015/0076124 A1 3/2015 Tsubaki et al.
2015/0077458 A1 3/2015 Osanai et al.
2015/0116689 A1* 4/2015 Lee ..... B23K 1/0016 355/72
2015/0138287 A1 5/2015 Saitoh
2015/0251453 A1 9/2015 Nakai et al.
2015/0336403 A1* 11/2015 Saito ..... D21H 25/04 347/101
2016/0009107 A1 1/2016 Nakai et al.
2016/0035610 A1* 2/2016 Park ..... H01J 37/32715 156/345.29
2016/0083839 A1 3/2016 Bright et al.
2016/0167402 A1 6/2016 Nakai et al.
2017/0117174 A1* 4/2017 Weichart ..... H01L 21/6831

FOREIGN PATENT DOCUMENTS

| | | |
|---|---|---|
| EP | 2875830 | 5/2015 |
| EP | 2974871 | 1/2016 |
| JP | 2016060157 | 4/2016 |
| KR | 20130033218 | 4/2013 |
| KR | 20130075512 | 7/2013 |
| WO | 9735726 | 10/1997 |
| WO | 2006128854 | 12/2006 |
| WO | 2010116041 | 10/2010 |
| WO | 2013132343 | 9/2013 |
| WO | 2016064860 | 4/2016 |
| WO | 2016068983 | 5/2016 |

OTHER PUBLICATIONS

Yousefi et al., Investigation of glow discharge plasma for surface modification of polypropylene, Wiley Online Library, http://onlinelibrary.wiley.com/doi/10.1002/sia.1633/abstract, 2003.
International Search Report dated Apr. 27, 2017 for PCT/US2016/042967, Applicant Hewlett-Packard Development Company, L.P.

* cited by examiner

PLASMA TREATMENT HEADS

BACKGROUND

Plasma coating or plasma polymerization can be used to deposit functional material or treatment composition onto surfaces for various applications. For example, thermal plasma spraying is used industrially to coat a material such as a metal or ceramic onto a surface. Thermal plasma is created by heating a carrier gas to a very high temperature to induce a plasma state in the gas. Coating material mixed with carrier gas can be sprayed onto a surface to coat the surface. In other examples, non-thermal plasma can be used to apply coatings. Non-thermal plasma differs from thermal plasma in that non-thermal plasma is not at thermodynamic equilibrium. In other words, the electrons in a non-thermal plasma have an electron temperature that is different from the remaining ions in the plasma. Non-thermal plasma can include "cold plasma," which refers to plasma formed at near room temperature and near atmospheric pressure.

Some systems for coating materials using cold plasma have included an enclosed container with a pair of plasma generating electrodes inside. An object to be coated is placed between the electrodes, and then plasma is induced between the electrodes while a coating material is sprayed into the enclosed container. In some cases, the coating material can be a monomer that is induced to polymerize by free radicals in the plasma. In other examples, a polymerizable coating composition can be sprayed onto an object first, and then the object can be placed between the electrodes to induce polymerization of the coating by the plasma.

DETAILED DESCRIPTION

The present disclosure is drawn to plasma treatment heads including injection holes that can be used to inject functional materials or treatment compositions into the plasma arcs generated by the plasma treatment heads. The plasma treatment heads can be used to treat surfaces with plasma while also depositing functional material or treatment composition onto the surfaces. In some examples, such plasma treatment heads can be used for pretreating printing media substrates before printing and post-treating printing media substrates after images have been printed thereon. Accordingly, the present disclosure also includes printing systems that include plasma treatment heads and inkjet print heads for forming printed images. Additionally, the present disclosure also describes methods of plasma treating media substrates.

In some examples of the present technology, the plasma treatment head can include a surface barrier discharge plasma generator. This particular type of plasma generator is a type of dielectric barrier discharge plasma generator, and includes electrodes located beneath a surface of a dielectric material. The electrodes can be separated from each other and from the media substrate by the dielectric material. In certain examples, the electrodes can be embedded within a dielectric barrier, such as a dielectric plate. When a high voltage, high frequency electric current is applied to the electrodes, plasma arcs can form on the surface of the dielectric barrier. The surface where the plasma arcs are located can be referred to as the treatment surface. This treatment surface can be placed in contact with or proximity to a substrate to be treated with the plasma treatment head.

In certain examples, the surface barrier discharge plasma generator can be a coplanar surface barrier discharge plasma generator. For example, the electrodes can be oriented in a common plane beneath the surface of the dielectric material. In this arrangement, the surface barrier may be in the form of a plate, e.g., the dielectric material can be a flat planar surface. In other examples, however, the dielectric material can have a curved or other shape, and the electrodes can be oriented beneath the surface to conform to the shape of the surface. For example, the electrodes can be located at an approximately uniform distance beneath the surface.

In further examples, the dielectric barrier can include injection holes penetrating through the dielectric barrier. The injection holes can be located between the electrodes and oriented so that the exit of the holes is at the treatment surface of the dielectric barrier. Thus, a functional material or treatment composition can be injected through the injection holes directly into the plasma arcs forming on the treatment surface. In this manner, the treatment material or functional material or treatment composition can be deposited on a media substrate, for example.

Figure 1A:
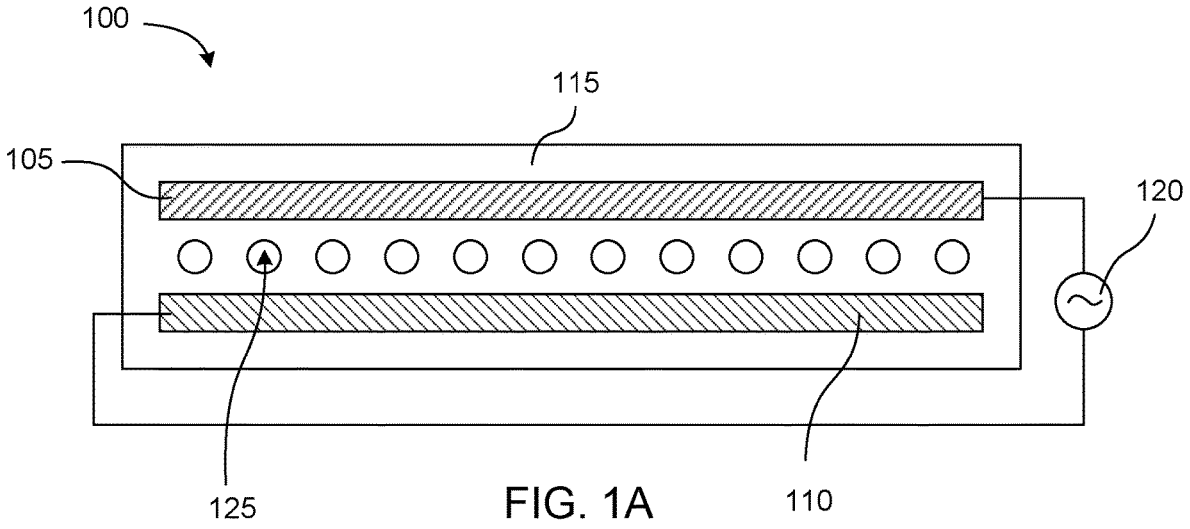
FIG. 1A is a schematic cross-sectional top view of an example plasma treatment head in accordance with examples of the present disclosure.
Figure 1B:
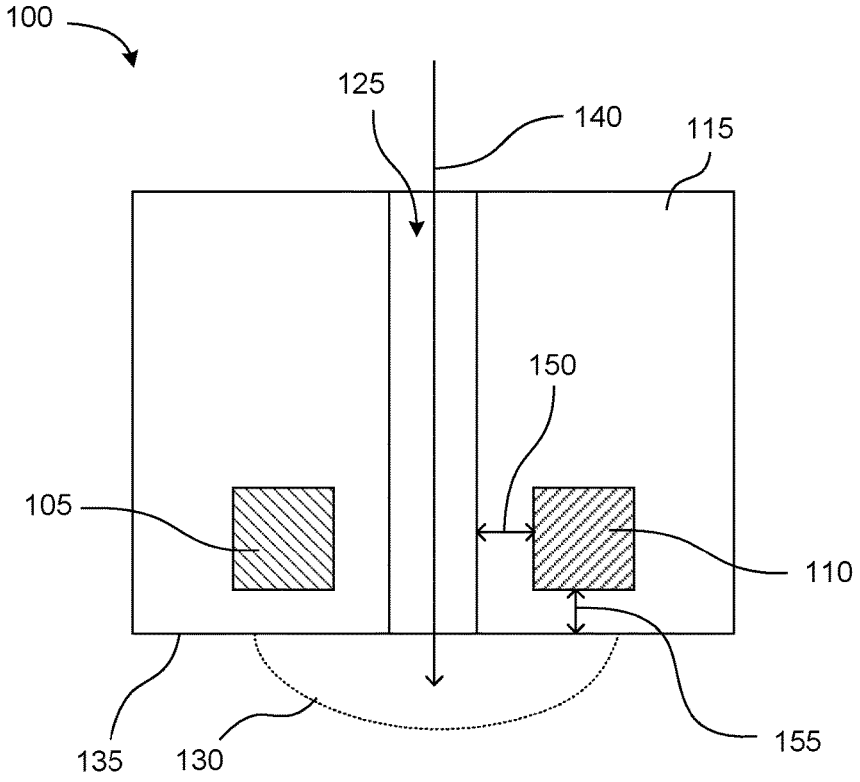
FIG. 1B is a schematic cross-sectional end view of an example plasma treatment head in accordance with examples of the present disclosure.

FIGS. 1A-1B show an example of a plasma treatment head 100 having a first electrode 105 and a second electrode 110 embedded in a dielectric barrier plate 115. A row of injection holes 125 is located between the first electrode and the second electrode. FIG. 1A shows a top cross-sectional view. A power supply 120 applies a potential difference across the first electrode and second electrode. FIG. 1B shows an end cross-sectional view. Plasma arcs 130 (one shown in this view) can form along a treatment surface 135 of the dielectric plate. Thus, the plasma treatment head can operate as a surface barrier discharge plasma generator. A functional material or treatment composition 140 can be injected through the injection holes directly into the plasma arcs.

In some examples, the power supply can provide a high voltage alternating current. In certain examples, the surface barrier discharge plasma generator can be operated at a voltage from 1 kV to 30 kV. In further examples, the high voltage alternating current can have a frequency from 1 kHz to 500 kHz.

As shown in FIG. 1B, the first electrode 105 and second electrode 110 may be oriented in a common plane embedded within the dielectric plate 115. The plasma arcs 130 may be confined to a volume close to the treatment surface 135 of the dielectric plate. For this reason, the plasma arcs in this example can be referred to as a "surface dielectric barrier discharge" which can be generated from a "surface barrier discharge plasma generator" described herein. This is different from a plasma generator that generates a volumetric dielectric barrier discharge. Volumetric dielectric barrier discharge occurs in a volumetric space between two electrodes, rather than from a common surface. In volumetric dielectric barrier discharge plasma systems, electrodes may be oriented in parallel planes, such as two parallel plate electrodes with a dielectric barrier between the electrodes in the space between the electrodes from two different surfaces. Thus, plasma arcs form in the volume between the electrodes. However, in the surface barrier discharge plasma generator 100 shown in FIG. 1B, the plasma arcs occur along a surface that is common to both electrodes of the dielectric barrier, which in this instance is a dielectric plate. This plasma tends to be more homogenous and has a higher energy density than volumetric dielectric barrier discharge plasma.

In some examples, the plasma generated by the coplanar dielectric barrier discharge plasma generator can have a depth from 0.1 mm to 2 mm. In other words, the plasma can extend to a distance of 0.1 mm to 2 mm from the surface of the dielectric plate. In further examples, the plasma can have a depth from 0.2 mm to 1.5 mm or from 0.5 mm to 1 mm. The plasma can have a high energy density, for example from 50 $W/cm^3$ to 250 $W/cm^3$. In further examples, the plasma can have an energy density from 75 $W/cm^3$ to 200 $W/cm^3$ or from 80 $W/cm^3$ to 150 $W/cm^3$. In terms of surface area of the media substrate being treated, the energy density of the plasma can be from 0.5 $W/cm^2$ to 250 $W/cm^2$, from 1 $W/cm^2$ to 50 $W/cm^2$, or from 2 $W/cm^2$ to 10 $W/cm^2$, in some examples.

The plasma generated by the surface barrier discharge plasma generator can be "cold" plasma. For example, the plasma can have a temperature of less than 50° C. Thus, the plasma can safely be used to treat media substrates such as paper without damaging the substrates due to high temperatures.

In some examples, the surface barrier discharge plasma generator can modify the surface of the media substrate so that the surface has improved interactions with inkjet ink. Without being bound to a particular mechanism, the plasma treatment can produce highly oxidizing species such as atomic oxygen and hydroxyl radicals. These species can react with components in the media substrate to form oxygen-containing groups such as —OH groups and carbonyl groups. In certain examples, the plasma treatment can modify the surface of the media substrate without significantly changing the pH of the surface. In other words, the plasma treatment can modify the surface by forming certain oxygen-containing groups, but without forming a substantial quantity of acid groups on the surface.

In further examples, the surface barrier discharge plasma generator can also have the effect of forming cationic species in the surface of the media substrate, depending on the type of media substrate used. For example, many types of paper contain calcium carbonate, which is added when the paper is manufactured. The plasma treatment can in some cases convert the calcium carbonate into calcium ions. For example, the calcium carbonate can in some examples react to form $Ca^{2+}$ and $CO_2$. In further examples, the calcium carbonate can be converted to calcium nitrate. Unlike calcium carbonate, which is insoluble in water, calcium nitrate is soluble in water and can supply $Ca^{2+}$ ions when an aqueous ink is printed on the surface. The $Ca^{2+}$ ions can act as a fixer when the ink is printed on the surface. In still further examples, the media substrate may include other components that can be converted into cationic species by the plasma treatment. Regardless of whether these chemical reactions occur or not in each and every case, irrespective of the various possible mechanisms, it has been observed that print quality can be improved on a wide variety of papers using the surface barrier discharge plasma generators as described herein.

The plasma generated by the surface barrier discharge plasma generator can also supply radicals to initiate polymerization reactions. Accordingly, such a plasma generator can be used to treat images printed with curable ink so that the ink polymerizes and becomes cured. In further examples, a functional material or treatment composition containing polymerizable components can be injected through the injection holes in the plasma pretreatment head, and the radicals supplied by the plasma can initiate polymerization of the functional material or treatment composition.

In further examples, the surface barrier discharge plasma generator can operate at atmospheric pressure in an atmosphere of normal air. Unlike some other types of plasma generators, surface barrier discharge plasma generators in some cases do not require reduced pressure or any special gas flow to operate. For example, some other types of plasma generators employ high gas flows to blow a plasma arc out of a nozzle. The gas required for these systems in some cases includes noble gases such as Argon or Helium. In contrast, the surface barrier discharge plasma generators described herein can be used at normal atmospheric conditions.

Referring again to FIGS. 1A and 1B, the plasma treatment head 100 can include a plurality of injection holes 125 located between the first electrode 105 and the second electrode 110. The injection holes penetrate through the dielectric plate 115. The injection holes open on one end at the treatment surface 135. In some examples, the plasma arcs 130 can tend to form at or near a shortest path between the electrodes through the dielectric plate. Accordingly, the electrodes can be located near the treatment surface of the dielectric plate so that the plasma arcs form on the treatment surface. In certain examples, the size, location and spacing of the injection holes can be selected so that a distance 150 from the electrodes to the injection holes is greater than a distance 155 from the electrodes to the treatment surface. However, in other examples, the distances can be equal or the distance from the electrodes to the injection holes can be less than the distance from the electrodes to the treatment surface.

Figure 2A:
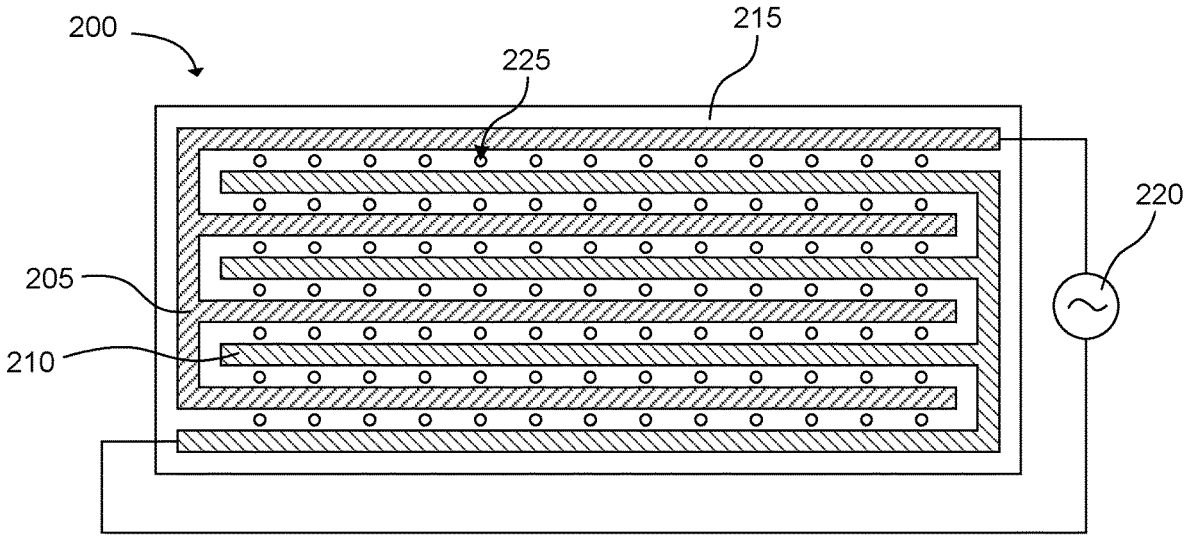
FIG. 2A is a schematic cross-sectional top view of an example plasma treatment head in accordance with examples of the present disclosure.
Figure 2B:
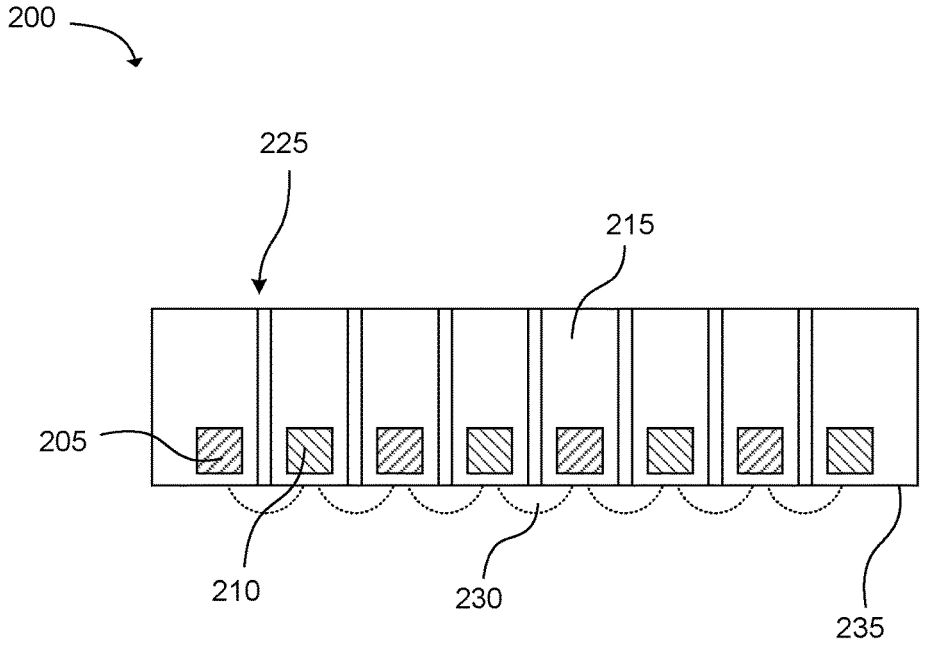
FIG. 2B is a schematic cross-sectional end view of an example plasma treatment head in accordance with examples of the present disclosure.

FIGS. 2A and 2B show another example of a plasma treatment head 200. In this example, a first electrode 205 and a second electrode 210 are shaped with interdigitated fingers. In this arrangement, plasma arcs 230 can form between each set of first and second electrode fingers. The electrodes are embedded in a dielectric barrier 215 beneath a treatment surface 235 of the dielectric barrier (which is a dielectric plate in this example). A plurality of injection holes 225 are arranged in rows between pairs of first and second electrodes. A power supply 220 can supply a high voltage, high frequency current to the electrodes to generate the plasma arcs on the treatment surface. The injection holes can be used to inject a functional material or treatment composition directly into the plasma arcs.

In some examples, the injection holes can be spaced apart at an appropriate distance for depositing the functional material or treatment composition onto a media substrate. For example, the spacing can be selected so that the media substrate receives roughly even coverage of the functional material or treatment composition. In some cases, the holes can be spaced farther apart if the plasma treatment head is positioned at a greater distance from the media substrate. Similarly, if the plasma treatment head is positioned closer to the media substrate then the injection holes may be spaced more closely together. In further examples, the injection holes can be oriented in multiple rows and the rows can be offset to increase the uniformity of coverage of functional material or treatment composition deposited onto the media substrate. In various examples, injection holes can spaced from about 1 mm to about 50 mm apart. In further examples, the injection holes can be spaced from about 2 mm to about 20 mm apart.

In additional examples, the injection holes can have a diameter from about 0.5 mm to about 5 mm. Larger diameters can allow for a higher flow rate of functional material or treatment composition. However, in some cases the diameter of the holes can be selected so that the distance between the electrodes and the holes is greater than the distance between the electrodes and treatment surface of the plasma treatment head, as mentioned above. As used herein, "diameter" can refer to the actual diameter of a circular injection hole, or to the longest dimension of an injection hole having a different shape. In certain examples, the injection holes can be circular holes, square holes, rectangular slots, or a variety of other shapes. In various examples, the electrodes can be spaced apart from about 2 mm to about 20 mm. Additionally, the electrodes can be located from about 0.5 mm to about 5 mm beneath the treatment surface of the dielectric plate. Thus, the diameter of the injection holes can be selected accordingly.

Figure 3:
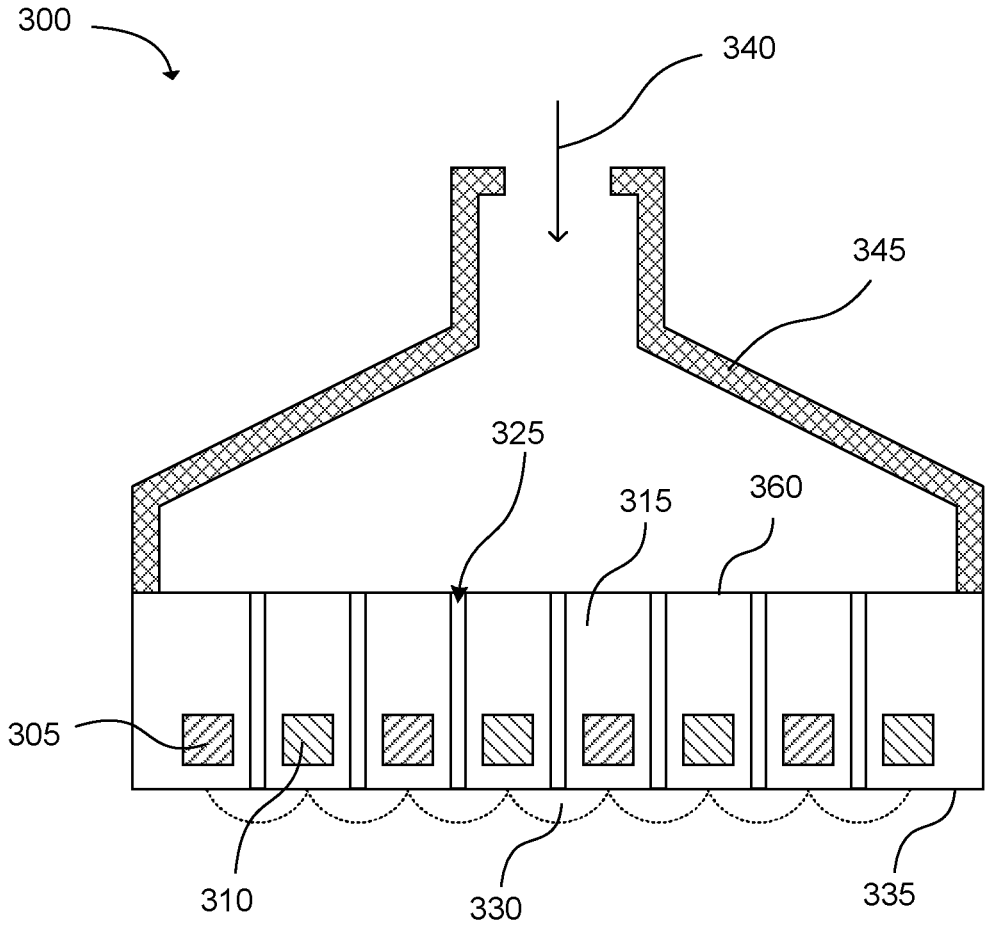
FIG. 3 is a schematic cross-sectional end view of an example plasma treatment head in accordance with examples of the present disclosure.

FIG. 3 shows another example of a plasma treatment head 300 including a first electrode 305, second electrode 310, dielectric plate 315, and injection holes 325 penetrating through the dielectric plate. An injection manifold 345 is oriented at an interior surface 360 of the dielectric plate. The injection manifold is in fluid communication with the injection holes. A functional material or treatment composition 340 can be introduced into the injection manifold and therefrom injected through the injection holes into the plasma arcs 330 on the treatment surface 335.

In various embodiments, the functional material or treatment composition can be introduced into the injection manifold from any suitable functional material source. Depending on the type of functional material or treatment composition being injected, the source can include pressurized gas tanks, compressors, pumps, blowers, aerosolizers, and so on.

The plasma treatment heads described herein can be used to treat printing media substrates. In some examples, a plasma treatment head can be used to pretreat a media substrate before printing, to post-treat a printed image after printing, or both. Accordingly, in some examples printing systems can be constructed including a plasma treatment head to pretreat the media substrate, a plasma head to post-treat the printed image, or both.

Figure 4A:
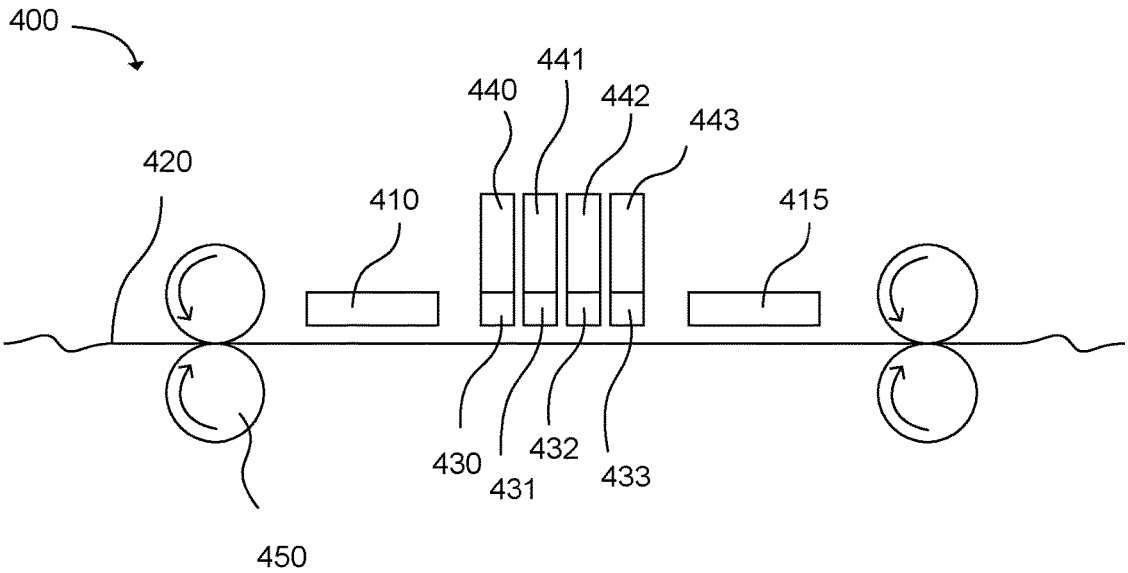
FIG. 4A is a schematic side view of an example printing system in accordance with examples of the present disclosure.

FIG. 4A shows a schematic side view of an example of a printing system 400 including a first plasma treatment head 410 and a second plasma treatment head 415. The printing system includes inkjet print heads 430, 431, 432, 433. The inkjet print heads are positioned to print an image on a media substrate 420. The inkjet print heads can be used to print different colors, such as cyan, magenta, yellow, black, blue, green, red, purple, orange, gray, etc. In certain examples, the colors may be cyan, magenta, and yellow (three colors); or cyan, magenta, yellow, and black (four colors). The inkjet print heads may also be in fluid communication with ink reservoirs 440, 441, 442, 443, and may carry the inks. The media substrate, as shown, can be conveyed past the pretreatment head and the inkjet print heads by conveyors 450. The first plasma treatment head can be positioned with respect to the inkjet print heads to treat the media substrate before the image is printed on the media substrate. The second plasma treatment head can be positioned with respect to the inkjet print heads to treat the printed image after the image has been applied to the media substrate.

As shown in FIG. 4A, the inkjet print heads 430, 431, 432, and 433 and plasma treatment heads 410 and 415 can be positioned a small distance above the surface of the media substrate 420. The inkjet print heads can be positioned at a distance typically used in inkjet printing. In various examples, the plasma treatment heads can be positioned over a range of distances from the media substrate. In one example, the plasma treatment heads can be positioned up to 10 mm from the surface of the media substrate. For example, the plasma treatment heads can independently be from 0.1 mm to 10 mm from the surface of the media substrate. Depending on the distance of the plasma generator from the media substrate, the media substrate can be within the plasma arcs or beneath the plasma arcs. In some examples, the printed image on the media substrate can be effectively treated either within the plasma arcs or beneath the plasma arcs. In further examples, the plasma generator can be fixed at a distance from the media substrate, or moveable with respect to the media substrate so that the distance can be adjusted.

Figure 4B:
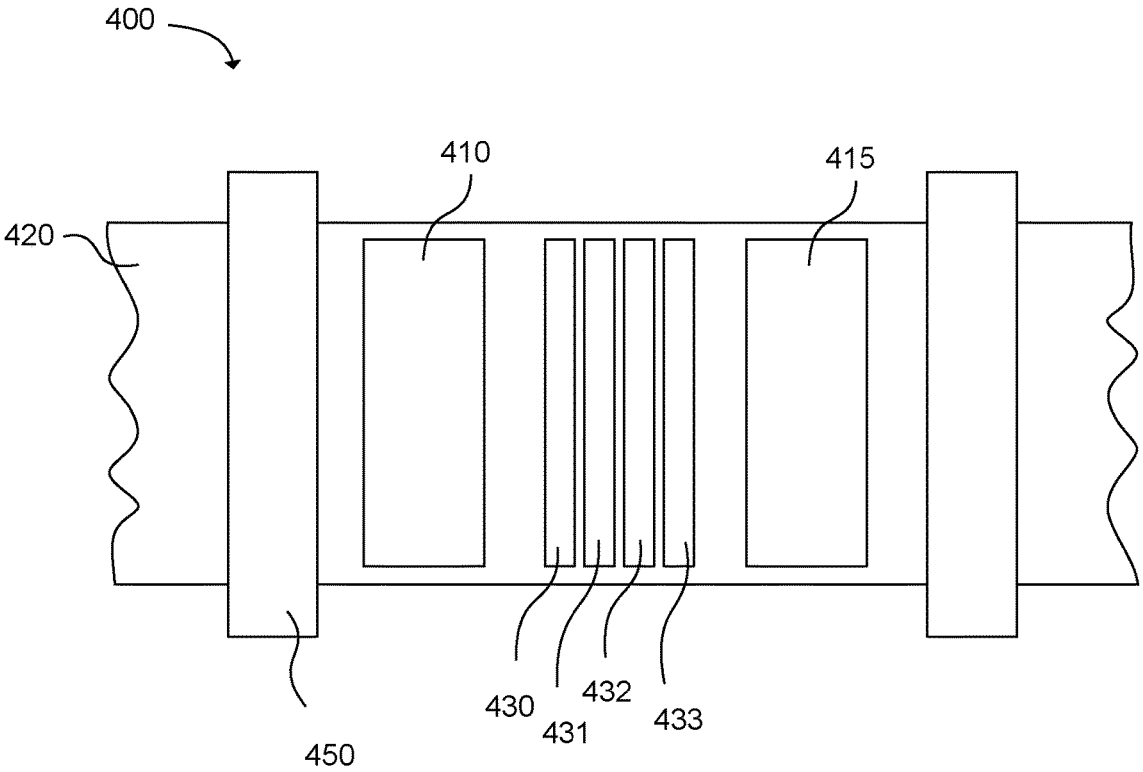
FIG. 4B is a schematic top view of an example printing system in accordance with examples of the present disclosure.

FIG. 4B shows a schematic top view of the printing system of FIG. 4A. As shown in FIG. 4B, the inkjet print heads 430, 431, 432, 433 and plasma treatment heads 410, 415 can have nearly the same width as the media substrate 420. In certain examples, the plasma treatment heads can be 75% or more as wide as the media substrate, or 90% or more as wide as the media substrate. In further examples, the plasma treatment heads can be as wide as the media substrate or wider.

In some examples, the inkjet print heads and plasma treatment heads can be held stationary while the media substrate is conveyed past. Thus, in one example, the plasma treatment heads can plasma treat the entire width of the media substrate or a portion of the media substrate as wide as the plasma treatment heads. In other examples, it may be that the plasma treatment heads and/or the inkjet print heads may also be movable on a carriage and traverse the media substrate. In other words, in the example shown, these features are static, but they may alternatively be movable.

In some examples, the plasma treatment heads can be positioned at a distance from the inkjet print heads. The first plasma treatment head can pretreat the media substrate before printing. This plasma pretreatment can effectively modify the surface of the media substrate very quickly, so that distance between the first plasma treatment head and the inkjet print heads is not particularly limiting, e.g., many different distances can be used. Additionally, the plasma treatment can retain its effect on the surface of the media substrate for an extended time, such as more than one month or more than one year. Thus, no particular proximity of distance or time between use of the first plasma treatment head and the inks impact the result. However, in some examples, the first plasma treatment head can be positioned directly adjacent to the inkjet print heads. In other examples, the first plasma treatment head can be positioned any convenient distance from the inkjet print heads, such as from 1 mm to 10 meters away from the inkjet print heads. This can provide advantages over printing systems that apply a liquid fixer solution to a media substrate before printing, because such systems often employ a drying zone between the fixer application and the print heads. Such systems can use a drying oven or a long distance between the fixer application and the print heads to allow water and/or other solvents in the fixer solution to evaporate. In some cases, such printing systems run at a slower printing speed to give the fixer solution more time to dry. In contrast, the plasma treatment used in the present technology can be a dry treatment in which no liquid is added to the media substrate. Thus, in some examples, no drying zone is included between the first plasma treatment head and the inkjet print heads.

In further examples, the first plasma treatment head can be used to apply a functional material or treatment composition injected through the injection holes. In one such example, a fixer composition can be applied through the injection holes. In some cases, the fixer composition can be a liquid aerosol composition. In this case, a drying zone may be used between the first plasma treatment head and the inkjet print heads. However, in some cases a smaller amount of fixer composition can be applied than would be required in a conventional coating arrangement without a plasma generator. The plasma from the first plasma treatment head can modify the surface of the media substrate itself to have improved ink fixing ability, while the fixer composition can further improve the ink fixing ability of the surface.

In further examples, the distance between the inkjet print heads and the second plasma treatment head can be sufficient to allow the printed image to partially or fully dry before the image is plasma treated. In some examples, the inkjet print heads can print a curable inkjet ink onto the media substrate and the second plasma treatment head can be used to cure the curable inkjet ink. In certain examples, the curable inkjet ink can produce a stronger cure when the ink has been allowed to dry. However, some inks may produce a stronger cure if they are cured when still wet. Thus, the position of the second plasma treatment head can be selected based on the characteristics of the ink being employed. In further examples, the printing system can include a dryer or drying zone between the inkjet print heads and the plasma generator. The dryer or drying zone can dry the ink making up the printed image more quickly. For example, a dryer can include a heater to heat the printed image to evaporate water and/or volatile solvents in the ink.

In still further examples, a functional material or treatment composition can be injected through the injection holes of the second plasma treatment head to improve or speed curing of the curable ink. In one example, a cross-linking agent can be injected to improve curing of the curable ink.

In other examples, the second plasma treatment head can be used to inject a polymerizable overcoat composition. In certain examples, the polymerizable overcoat composition can include monomers, oligomers, or polymers that can be polymerized or crosslinked by radicals generated by the second plasma treatment head. The polymerizable overcoat composition can be injected through the injection holes of the second plasma treatment head to form a protective overcoat layer over the printed image on the media substrate. In one example, the overcoat layer can be colorless and transparent. In further examples, the overcoat layer can have a high gloss appearance, semi gloss appearance, or matte appearance.

In more specific examples, the polymerizable overcoat composition can include a monomer having an unsaturated bond that can polymerize upon exposure to radicals. In some examples, the monomer can be an alkane such as 1-hexene. In further examples, the monomer can be acrylic acid, methacrylic acid, or a derivative thereof. In still further examples, the monomer can be a vinylsilane such as vinyltriethoxysilane. In additional examples, the monomer can be an alkoxylated acrylate or methacrylate such as polyethylene glycol methacrylate or trimethylolpropane ethoxylate triacrylate. In yet further examples, the monomer can be a perfluorinated alkene such as tetrafluoroethylene. Combinations of the various monomers described above can also be used.

Figure 5:
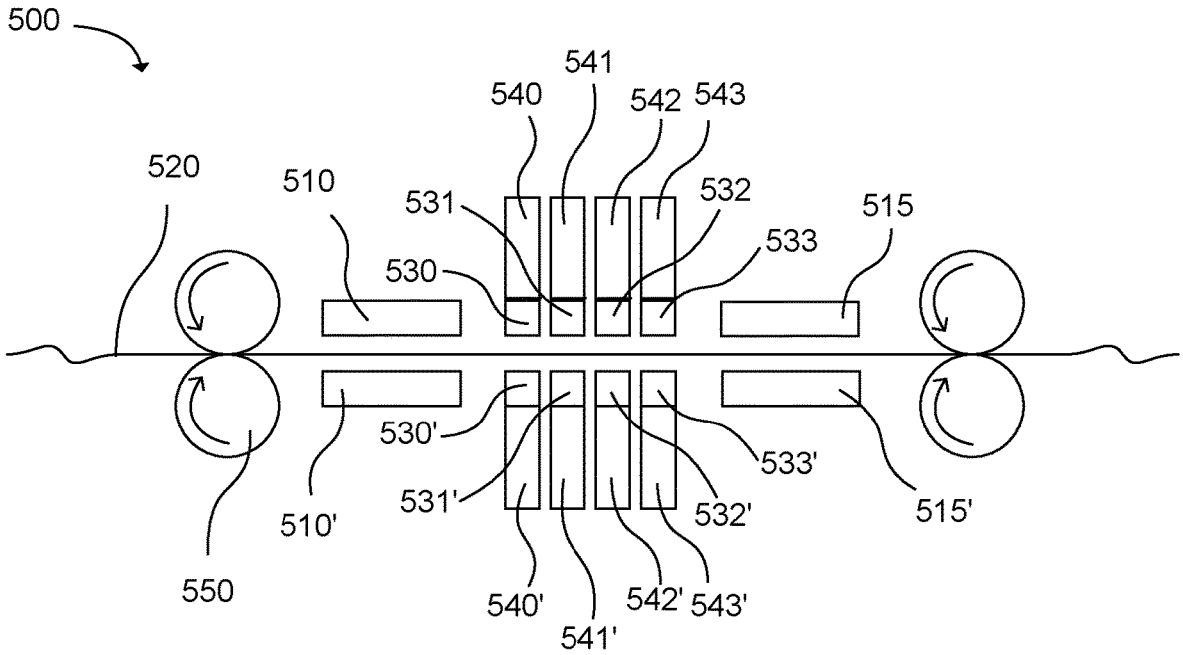
FIG. 5 is a schematic side view of an example printing system in accordance with examples of the present disclosure.

It should be noted that the example shown in FIGS. 4A and 4B is only a single example of the presently disclosed technology. In other examples, printing systems according to the present disclosure can have a variety of different configurations. FIG. 5 shows another example of a printing system 500 that includes inkjet print heads 530, 531, 532, 533 in fluid communication with ink reservoirs 540, 541, 542, 543. A plasma pretreatment head 510 and plasma post-treatment head 515 are positioned before and after the inkjet print heads, respectively. These components are positioned to plasma treat a first surface of the media substrate 520, print on the first surface of the media substrate, and plasma treat the media substrate and the printed image after printing. Another set of inkjet print heads 530', 531', 532', 533' in fluid communication with ink reservoirs 540', 541', 542', 543' and another plasma pretreatment head 510' and plasma post-treatment head 515' are positioned on an opposite side of the media substrate to print and treat the opposite surface of the media substrate. The media substrate is conveyed between the two sets of inkjet print heads and plasma treatment heads by conveyors 550. Thus, the system can pretreat, print, and post-treat both surfaces of the media substrate simultaneously.

In other examples, the plasma treatment heads and/or the inkjet print head can be movable with respect to the media substrate. For example, in a web fed printing system the plasma treatment heads and/or inkjet print head can move in a direction perpendicular to the movement direction of the media web. In another example, the printing system can be sheet fed. A media substrate sheet can be fed by conveyors past the plasma treatment heads and inkjet print head, while the plasma treatment heads and/or inkjet print head can move in a direction perpendicular to the movement direction of the media sheet. In a further example, the printing system can have a static printing bed on which a media substrate sheet is placed. The plasma treatment heads and/or the inkjet print head can move in two dimensions (i.e., the x-axis and y-axis directions) over the media substrate sheet to pretreat the media substrate sheet, print on the media substrate sheet, and post-treat the printed image.

Figure 6:
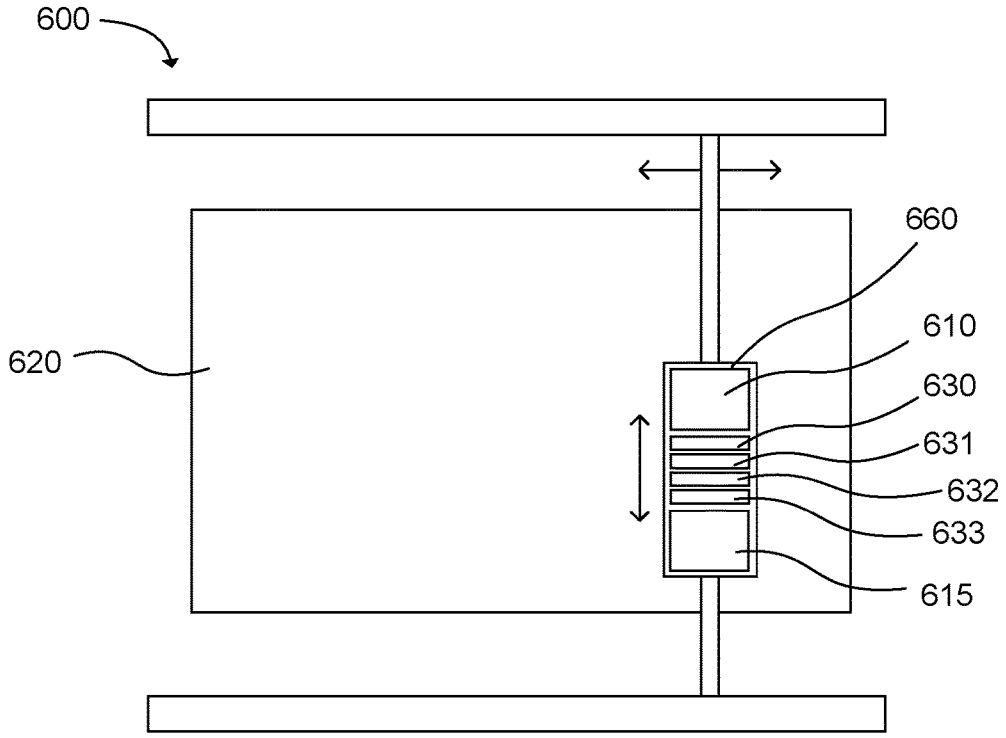
FIG. 6 is a schematic top view of an example printing system in accordance with examples of the present disclosure.

FIG. 6 shows an example of a printing system 600 including a stationary media substrate sheet 620. In this system, a first plasma treatment head 610, inkjet print heads 630, 631, 632, 633, and a second plasma generator 615 are located together on a carriage 660. The carriage is moveable in the x-axis and y-axis directions. The first plasma treatment head can pass over an area of the media substrate sheet first to pretreat the area, and then inkjet print heads can pass over the pretreated area to print an image on the pretreated area. Additionally, the second plasma treatment head can pass over the printed image to post-treat the printed image.

As mentioned above, the printing systems described herein can include an inkjet print head. In some examples, a printing system can include a single inkjet print head. The inkjet print head can be in fluid communication with a reservoir of black ink or a colored ink. In other examples, the printing system can include multiple inkjet print heads. For example, the printing system can include an inkjet print head for several different colors, such as cyan, magenta, yellow, and black. In further examples, other colors of ink can be included.

As used herein, "inkjetting" or "jetting" refers to ejecting compositions from jetting architecture, such as inkjet architecture. Inkjet architecture can include thermal, piezo, or continuous inkjet architecture. A thermal inkjet print head can include a resistor that is heated by electric current. Inkjet ink can enter a firing chamber and the resistor can heat the ink sufficiently to form a bubble in the ink. The expansion of the bubble can cause a drop of ink to be ejected from a nozzle connected to the firing chamber. Piezo inkjet print heads are similar, except that instead of a thermal resistor, a piezoelectric element is used to mechanically force a drop of ink out of a nozzle. In a continuous inkjet printing system, a continuous stream of ink droplets is formed and some of the droplets can be selectively deflected by an electrostatic field onto the media substrate. The remaining droplets may be recirculated through the system. Inkjet print heads can be configured to print varying drop sizes such as less than 10 picoliters, less than 20 picoliters, less than 30 picoliters, less than 40 picoliters, less than 50 picoliters, etc.

In some cases, the ink used in the printing systems described herein can be a water-based inkjet ink or a solvent-based inkjet ink. Inkjet inks generally include a colorant dispersed or dissolved in an ink vehicle. As used herein, "liquid vehicle" or "ink vehicle" refers to the liquid fluid in which a colorant is placed to form an ink. A wide variety of ink vehicles may be used with the methods of the present disclosure. Such ink vehicles may include a mixture of a variety of different agents, including, surfactants, solvents, co-solvents, anti-kogation agents, buffers, biocides, sequestering agents, viscosity modifiers, surface-active agents, water, etc.

Generally the colorant discussed herein can include a pigment and/or dye. As used herein, "dye" refers to compounds or molecules that impart color to an ink vehicle. As such, dye includes molecules and compounds that absorb electromagnetic radiation or certain wavelengths thereof. For example, dyes include those that fluoresce and those that absorb certain wavelengths of visible light. In some cases, dyes can be water soluble. In other cases, dyes can be solvent soluble, such as being soluble in ethanol or another organic solvent. Furthermore, as used herein, "pigment" generally includes pigment colorants, magnetic particles, aluminas, silicas, and/or other ceramics, organo-metallics or other opaque particles. In one example, the colorant can be a pigment.

In certain examples, the colorant can be a pigment having a dispersing group covalently bonded to surfaces of the pigment. The dispersing groups can be, for example, small groups, oligomeric groups, polymeric groups, or combinations thereof. In other examples, the pigment can be dispersed with a separate dispersant. Suitable pigments include, but are not limited to, the following pigments available from BASF: Paliogen® Orange, Heliogen® Blue L 6901F, Heliogen® Blue NBD 7010, Heliogen® Blue K 7090, Heliogen® Blue L 7101F, Paliogen® Blue L 6470, Heliogen® Green K 8683, and Heliogen® Green L 9140. The following black pigments are available from Cabot: Monarch® 1400, Monarch® 1300, Monarch® 1100, Monarch® 1000, Monarch® 900, Monarch® 880, Monarch® 800, and Monarch® 700. The following pigments are available from CIBA: Chromophtal® Yellow 3G, Chromophtal® Yellow GR, Chromophtal® Yellow 8G, Igrazin® Yellow 5GT, Igrantee Rubine 4BL, Monastral® Magenta, Monastral® Scarlet, Monastral® Violet R, Monastral® Red B, and Monastral® Violet Maroon B. The following pigments are available from Degussa: Printex® U, Printex® V, Printex® 140U, Printex® 140V, Color Black FW 200, Color Black FW 2, Color Black FW 2V, Color Black FW 1, Color Black FW 18, Color Black S 160, Color Black S 170, Special Black 6, Special Black 5, Special Black 4A, and Special Black 4. The following pigment is available from DuPont: Tipure® R-101. The following pigments are available from Heubach: Dalamar® Yellow YT-858-D and Heucophthal Blue G XBT-583D. The following pigments are available from Clariant: Permanent Yellow GR, Permanent Yellow G, Permanent Yellow DHG, Permanent Yellow NCG-71, Permanent Yellow GG, Hansa Yellow RA, Hansa Brilliant Yellow 5GX-02, Hansa Yellow-X, Novoperm® Yellow HR, Novoperm® Yellow FGL, Hansa Brilliant Yellow 10GX, Permanent Yellow G3R-01, Hostaperm® Yellow H4G, Hostaperm® Yellow H3G, Hostaperm® Orange GR, Hostaperm® Scarlet GO, and Permanent Rubine F6B. The following pigments are available from Mobay: Quindo® Magenta, Indofast® Brilliant Scarlet, Quindo® Red R6700, Quindo® Red R6713, and Indofast® Violet. The following pigments are available from Sun Chemical: L74-1357 Yellow, L75-1331 Yellow, and L75-2577 Yellow. The following pigments are available from Columbian: Raven® 7000, Raven® 5750, Raven® 5250, Raven® 5000, and Raven® 3500. The following pigment is available from Sun Chemical: LHD9303 Black. Any other pigment and/or dye can be used that is useful in modifying the color of the ink. Additionally, the colorant can include a white pigment such as titanium dioxide, or other inorganic pigments such as zinc oxide and iron oxide.

In further examples, the ink can include a binder. In some examples, the binder can be a latex polymer. In further examples, the binder can include polymers, copolymers, or combinations thereof. The polymers and copolymers can be formed of styrene, acrylic acid, methacrylic acid, methyl methacrylate, butyl acrylate, divinylbenzene, or combinations thereof. In another example, the binder can be a polyurethane binder.

In some cases the binder can be curable. That is, the binder can be further polymerized or cross-linked after the ink is printed onto the media substrate. In one such example, the binder can include a polymerizable polyurethane. The polymerizable polyurethane can be included in the ink in an amount from 5 wt % to 20 wt % in some examples. In further examples, the polymerizable polyurethane can be water dispersible and the ink can include an aqueous vehicle.

In certain examples, the polymerizable polyurethane binder can be formed from the following components: (a) a diisocyanate (b) a polyol, (c) an acrylate or methacrylate with two or more hydroxyl functional groups, (d) a compound including an ionic group or a group capable of forming an ionic group, and (e) another acrylate or methacrylate, the other acrylate or methacrylate having a hydroxyl functional group or an amino functional group. These components can be selected so that the resulting curable polyurethane binder has a weight average molecular weight (Mw) equal to or less than 5,000, a glass transition temperature (Tg) less than 25° C., a double bond density higher than 1.0, and an acid number ranging from 5 to 30.

In addition, the curable polyurethane binder disclosed herein may have a ratio of isocyanate groups (NCO) to hydroxyl groups (OH) (i.e., NCO:OH ratio) that is greater than 1.8. In another example, the NCO:OH ratio of the curable polyurethane binder is equal to or greater than 2.1. In yet another example, the NCO:OH ratio ranges from about 2.6 to about 2.8. In this NCO:OH ratio, it is to be understood that the number of hydroxyl groups (OH) making up the OH portion of the ratio is not the total number of hydroxyl groups in the polyurethane binder, but rather is determined from the hydroxyl groups of component (b) (polyol), component (c) (acrylate or methacrylate with two or more hydroxyl functional groups), and component (d) (the compound including an ionic group or a group to form an ionic group). As such, the total number of OH groups for the NCO:OH ratio is not based on hydroxyl groups from component (e). While not accounted for in this NCO:OH ratio, it is to be understood that the total number of hydroxyl groups (OH) in the polyurethane binder also includes any hydroxyl groups from component (e).

For component (a), any non-aromatic diisocyanate may be used. In an example, the non-aromatic diisocyanate may be hexamethylene-1,6-diisocyanate (HDI), 2,2,4-trimethylhexamethylene-diisocyanate, or a combination thereof. The polyurethane can exclude any other isocyanate. The amount of the non-aromatic diisocyanate within the curable binder dispersion can range from about 20 wt % to about 50 wt % of the total weight of the curable polyurethane. In an example, hexamethylene diisocyanate can make up from about 30 wt % to about 50 wt % of the polyurethane binder.

Turning to component (b), the amount of component (b) (i.e., the polyol) within the curable polyurethane binder dispersion can range from about 10 wt % to about 30 wt % of the total weight of the curable polyurethane. In an example, component (b) (i.e., the polyol) can make up from about 15 wt % to about 25 wt % of the polyurethane binder.

Component (b) can be a polyol. The term "polyol", as used herein, means any product having an average of about 2 or more hydroxyl groups per molecule. Some examples of suitable polyols for component (b) may be part of a first class of polyols. As examples, the first class of polyols has a number average molecular weight ranging from greater than 500 to about 5,000. In any of these examples, component (b) can be a macro-glycol. Examples of suitable polyols of the first class include polyester polyols, polyether polyols, polycarbonate polyols, poly(ethyleneoxide) polyols, polyhydroxy polyester amides, hydroxyl-containing polycaprolactones, hydroxyl-containing acrylic polymers, hydroxyl-containing epoxides, polyhydroxy polycarbonates, polyhydroxy polyacetals, polyhydroxy polythioethers, polysiloxane polyols, ethoxylated polysiloxane polyols, polybutadiene polyols, hydrogenated polybutadiene polyols, polyisobutylene polyols, polyacrylate polyols, halogenated polyesters and polyethers, or mixtures thereof. In an example, the polyol can be poly(propyleneglycol), poly(tetrahydrofuran), poly(ethyleneoxide), a polycarbonate polyol, or a polyester polyol.

Other examples of suitable polyols for component (b) may be part of a second class of polyols. The second class has a number average molecular weight that is 500 or lower. Examples of suitable polyols of the second class include 1,2-propanediol, 1,3-propanediol, 1,2-butanediol, 1,3-butanediol, 1,4-butanediol, 1,5-pentanediol, 3-methylpentane-1,5-diol, 1,6-hexanediol, neopentylglycol, cyclohexane-1,4-dimethanol, 1,2-cyclohexanediol, 1,4-cyclohexanediol, 2-ethyl-3-propylpentanediol, 2,4-dimethylpentanediol, 2-ethyl-2-butylpropanediol, diethyleneglycol, triethyleneglycol, tetraethyleneglycol, dipropyleneglycol, tripropyleneglycol, N-substituted ethanolamines, and mixtures thereof. In an example, the polyol is selected from 1,4-butanediol, 1,5-pentanediol, 3-methylpentane-1,5-diol, 1,6-hexanediol, neopentylglycol, and cyclohexane-1,4-dimethanol, trimethylolpropane, glycerol, or pentaerythritol.

It is to be understood that a combination of any of the listed polyols may be used.

The curable polyurethane binder dispersion may further include component (c). Component (c) includes an acrylate or methacrylate with two or more hydroxyl functional groups. In this example, the acrylate or methacrylate with two or more hydroxyl functional groups is present in an amount ranging from greater than 0 wt % to about 40 wt % based on the total weight of the curable polyurethane.

Some examples of the acrylate or methacrylate with two or more hydroxyl functional groups include those obtained from the reaction of diglycidyl compounds with (meth) acrylic acid. Aliphatic diglycidyl compounds derived from alpha, omega diols having 4 to 12 carbon atoms or from polyoxyalkylenediols (such as polyethylene glycol, polypropylene glycol, or mixtures thereof that contain oxyalkylene groups) may be used. Some specific examples include 1,4-butanediol diglycidyl ether, 1,6-hexanediol diglycidyl ether, cyclohexanedimethanol diglycidyl ether, polyethylene glycol diglycidyl ether, polypropylene glycol diglycidyl ether, hydrogenated bisphenol A diglycidyl ether (BGDA or BADGE), hydrogenated bisphenol F diglycidyl ether, and their ethoxylated and/or propoxylated equivalents. An additional example is 1,6-hexanediylbis[oxy(2-hydroxy-3,1-propanediyl)] bisacrylate. Some commercially available examples include MIRAMAR™ PE-210 and MIRAMAR™ PE-230 (Miwon Chemical).

In further examples, the acrylate or methacrylate with two or more hydroxyl functional groups can include aromatic diglycidyl compounds derived from bisphenol A and bisphenol F. Specifically, bisphenol A diglycidyl ether, bisphenol F diglycidyl ether and their ethoxylated and/or propoxylated equivalents may be used. Diglycidyl esters may also be used, such as diglycidyl phthalate, N,N-diglycidyl aniline, or N,N-diglycidyl-4-glycidyloxyaniline. Some specific examples include a diacrylate ester of bisphenol A diglycidyl ether (BGDA) and a dimethacrylate ester of bisphenol A diglycidyl ether (BGDM).

Component (d) is a compound including an ionic group or a group that is capable of forming an ionic group. The amount of component (d) within the curable binder dispersion ranges from greater than 0 wt % to about 10 wt % based upon the total weight of the curable polyurethane. In an example, component (d) makes up from about 2 wt % to about 6 wt % of the polyurethane binder.

The presence of component (d) assists in the ability of the polyurethane to be dissolved or dispersed in water after ionization with a base. Examples of component (d) may be derived from hydroxy-carboxylic acids having the general formula (HO)xQ(COOH)y, where Q is a straight or branched hydrocarbon radical containing 1 to 12 carbon atoms, and x and y each independently range from 1 to 3. Examples of suitable hydroxy-carboxylic acids include dimethylol propionic acid (DMPA), dimethylol butanoic acid (DMBA), citric acid, tartaric acid, glycolic acid, lactic acid, malic acid, dihydroxymaleic acid, dihydroxytartaric acid, or mixtures thereof. Hydroxyls or amines containing a sulfonate functional group can also be used as component (d). Examples include taurine and aminoethylaminopropylsulfonate (EPS). Hydroxyls or amines containing a phosphate functional group can also be used as component (d). An example includes glycerol phosphate disodium dehydrate.

Turning now to component (e), component (e) is an acrylate or methacrylate having a hydroxyl functional group or an amino functional group. The amount of component (e) in the curable polyurethane binder dispersion can range from greater than 10 wt % to about 65 wt % based upon the total weight of the curable polyurethane. In an example, component (e) makes up from about 20 wt % to about 50 wt % of the polyurethane binder.

Some examples of component (e) include the esterification products of aliphatic and/or aromatic polyols with acrylic acid or methacrylic acid. These products have a residual OH functionality of about 1. Some of these products also have two or more acrylic functionalities. Examples of component (e) include the partial esterification products of acrylic acid or methacrylic acid with tri-, tetra-, penta- or hexahydric polyols or mixtures thereof. These modified or unmodified polyols are partly esterified with acrylic acid, methacrylic acid or mixtures thereof until the desired residual hydroxyl functionality is reached. Suitable examples include acrylic or the methacrylic esters with linear and branched polyols in which the one or more hydroxyl functionality remains free, such as hydroxyalkylacrylates or hydroxyalkylmethacrylates having 1 to 20 carbon atoms in the alkyl group. Some specific examples include hydroxyethylacrylate (HEA), hydroxyethylmethacrylate (HEMA), hydroxybutylacrylate (HBA), hydroxybutylmethacrylate (HBMA), (3-(acryloxy)-2-hydroxypropylmethacrylate) (AHPMA), glycerol diacrylate, trimethylolpropane diacrylate, pentaerythritoltriacrylate (PETA), ditrimethylolpropane triacrylate (DTPTA), dipentaerythritol pentaacrylate (DPPA), and (poly)ethoxylated and/or (poly)propoxylated equivalents of glycerol diacrylate, trimethylolpropane diacrylate, PETA, DTPTA, or DPPA.

The ink used in the printing systems described herein can also include monomers that can be polymerized by exposure to radicals or other species generated by the plasma generator. In some examples, such polymerizable monomers can be used in addition to a polymerizable polyurethane dispersion as described above. In other examples, the ink can include polymerizable monomers without the polymerizable polyurethane dispersions described above.

In some examples, the ink can include polymerizable monomers that are hydrophobic. In certain examples, the polymerizable monomers can acrylate monomers, vinyl monomers, or combinations thereof. Examples of acrylate monomers can include 2-phenoxyethyl acrylate, isophoryl acrylate, isodecyl acrylate, tridecyl acrylate, lauryl acrylate, 2-(2-ethoxy-ethoxy)ethyl acrylate, tetrahydrofurfuryl acrylate, isobornyl acrylate, propoxylated acrylate, tetrahydrofurfuryl methacrylate, 2-phenoxyethyl methacrylate, isobornyl methacrylate and combinations thereof. Examples of vinyl monomers can include vinyl caprolactam, vinyl ether and any combinations thereof.

In certain examples, the polymerizable monomer can include vinyl caprolactams, hexanediol diacrylates, trimethylolpropane triacrylates, propoxylated neopentyl glycol diacrylates, ethoxylated bisphenol A diacrylate, tris(2-hydroxyethyl) isocyanurate triacrylate, or combinations thereof.

In further examples, the polymerizable monomers can be water-soluble or water-miscible. In some examples, the monomers can include esters of acrylic or methacrylic acid with polyethylene glycol or with a mono-, di-, tri- or tetra-hydric alcohol derived by ethoxylating a mono-, di, tri- or tetra-hydric aliphatic alcohol of molecular weight less than 200 with ethylene oxide. In further examples, the monomers can include acrylate esters of polyethylene glycols made from a polyethylene glycol having a molecular weight of from about 200 to about 1500, or from about 400 to about 800; or acrylic esters of ethoxylated trimethylolpropane, having from 9 to 30 ethoxylate residues, or from 10 to 20 ethoxylate residues. Other examples can include acrylate esters of polyethylene glycols made from a polyethylene glycol having a molecular weight of from about 200 to about 1500 and acrylic esters of ethoxylated trimethylolpropane having from 9 to 30 ethoxylate residues.

Still further examples of the polymerizable monomers can include polyethylene glycol (600) diacrylate, polyethylene glycol (400) diacrylate, methoxy polyethylene glycol (550) mono-acrylate, polyethylene glycol (6) mono-acrylate, 30 ethoxylated bisphenol-A diacrylate, ethoxylated (20) trimethylopropane-triacrylate, (15) ethoxylated trimethylopropane-triacrylate, tristryl phenol 18eo acrylate, glycerol 12eo triacrylate, and combinations thereof. In other examples, the monomers can be ethoxylated tri-methylpropane triacrylates.

Examples of suitable commercially available materials can include the following UV-curable materials available from Sartomer such SR415® (ethoxylated (20) trimethylolpropane-triacrylate), CN435® or SR9015®. Other examples of commercially available water-soluble or dispersible monomers include: CD550® (methoxy polyethylene glycol (350) mono-methacrylate), CD552® (methoxy polyethylene glycol (550) mono-methacrylate), SR259® (polyethylene glycol (200) diacrylate), SR344® (polyethylene glycol (400) diacrylate), SR603® (polyethylene glycol (400) dimethacrylate), SR610® (polyethylene glycol (600) diacrylate), SR252® (polyethylene glycol (600) di-methacrylate), SR604® (polypropylene glycol mono-methacrylate, SR256® (2-(2-ethoxyethoxy)ethyl acrylate), SR9035 (ethoxylated(15)trimethylolpropane triacrylate), all available from Sartomer; Ebecryl®11 (polyethylene glycol diacrylate), and Ebecryl®12 (polyether triacrylate) available from UCB; Genomer®1251 (polyethylene glycol 400 diacrylate), Genomer®1343 (ethoxylated trimethylolpropane triacrylate), Genomer® 1348 (glycerol-propoxy triacrylate), Genomer®1456 (polyether polyol tetra-acrylate), and diluent 02-645 (ethoxy ethyl acrylate), all available from Rahn.

In still further examples, the monomers can include acrylamides monomers. Representative and non-limiting examples of acrylamide water-soluble or water-miscible monomers include N-(2-hydroxyethyl) acrylamide; N,N'-methylene bis-acrylamides and/or N-isopropyl acrylamides. Commercially available water-soluble or dispersible monomers include, for examples, Flocryl®MBA available from SNF FLOERGER (France); Jarchem®HEAA or Jarchem®NIPAM both available from Jarchem (USA, N.J.).

The ink can further be devoid or substantially devoid of photoinitiators. Because the plasma generator is used to cure the ink, no UV radiation is necessary to cure the ink. Accordingly, the ink does not need to include a photoinitiator. Eliminating the photoinitiator from the ink can provide advantages such as making the ink more stable, increasing the shelf-life of the ink, and so on. Inks that contain curable components and photoinitiators can often undergo premature polymerization if exposed to UV light. Additionally, many photoinitiators are difficult to disperse or dissolve in aqueous ink vehicles. However, the present technology allows for the use of curable ink without a photoinitiator. Therefore, these problems can be avoided.

The ink used in the printing systems described herein can also include a liquid vehicle. In some examples, liquid vehicle formulations that can be used in the ink can include water and one or more co-solvents. The co-solvents can be present in total at from 1 wt % to 50 wt %, depending on the jetting architecture. Further, one or more non-ionic, cationic, and/or anionic surfactants can be present, ranging from 0.01 wt % to 20 wt % (if present). In one example, the surfactant can be present in an amount from 0.1 wt % to 20 wt %. The liquid vehicle can also include dispersants in an amount from 0.1 wt % to 20 wt %. The balance of the formulation can be purified water, or other vehicle components such as biocides, viscosity modifiers, materials for pH adjustment, sequestering agents, preservatives, and the like. In one example, the liquid vehicle can be more than 50 wt % water.

In further examples, the liquid vehicle can be a non-aqueous, solvent-based vehicle. In one example, the liquid vehicle can include ethanol and additional co-solvents. Classes of co-solvents that can be used can include organic co-solvents including aliphatic alcohols, aromatic alcohols, diols, glycol ethers, polyglycol ethers, caprolactams, formamides, acetamides, and long chain alcohols. Examples of such compounds include primary aliphatic alcohols, secondary aliphatic alcohols, 1,2-alcohols, 1,3-alcohols, 1,5-alcohols, ethylene glycol alkyl ethers, propylene glycol alkyl ethers, higher homologs ($C_6$-$C_{12}$) of polyethylene glycol alkyl ethers, N-alkyl caprolactams, unsubstituted caprolactams, both substituted and unsubstituted formamides, both substituted and unsubstituted acetamides, and the like. Specific examples of solvents that can be used include, but are not limited to, 2-pyrrolidinone, N-methylpyrrolidone, 2-hydroxyethyl-2-pyrrolidone, 2-methyl-1,3-propanediol, tetraethylene glycol, 1,6-hexanediol, 1,5-hexanediol and 1,5-pentanediol.

Surfactants that can be included in the ink can include alkyl polyethylene oxides, alkyl phenyl polyethylene oxides, polyethylene oxide block copolymers, acetylenic polyethylene oxides, polyethylene oxide (di)esters, polyethylene oxide amines, protonated polyethylene oxide amines, protonated polyethylene oxide amides, dimethicone copolyols, substituted amine oxides, and the like. Suitable surfactants can include, but are not limited to, liponic esters such as Tergitol™ 15-S-12, Tergitol™ 15-S-7 available from Dow Chemical Company, LEG-1 and LEG-7; Triton™ X-100; Triton™ X-405 available from Dow Chemical Company; LEG-1, and sodium dodecylsulfate.

Various other additives may be employed to enhance the properties of the ink composition for specific applications. Examples of these additives are those added to inhibit the growth of harmful microorganisms. These additives may be biocides, fungicides, and other microbial agents, which are routinely used in ink formulations. Examples of suitable microbial agents include, but are not limited to, NUOSEPT® (Nudex, Inc.), UCARCIDE™ (Union carbide Corp.), VANCIDE® (R.T. Vanderbilt Co.), PROXEL® (ICI America), ACTICIDE® (Thor Specialties Inc.) and combinations thereof. Sequestering agents such as EDTA (ethylenediaminetetraacetic acid) may be included to eliminate the deleterious effects of heavy metal impurities. From 0.001% to 2.0% by weight, for example, can be used. Viscosity modifiers may also be present, as well as other additives known to those skilled in the art to modify properties of the ink as desired. Such additives can be present at from 0.01% to 20% by weight.

In some examples, the inkjet ink can include ingredients in the amounts listed in Table 1:

TABLE 1

| Component | Weight Percent |
|---|---|
| Binder | 0.5-10% |
| Biocide | 0-5% |
| Surfactant | 0-10% |
| Anti-kogation agent | 0-5% |
| Colorant | 0.5-10% |
| Organic Co-solvent | 0.1-50% |
| Water* | Balance |

*Note that by "balance," what is meant is that water is used to achieve 100 wt %. Other ingredients other than the ones shown in Table 1 may be present, and water is used to arrive at 100 wt %, regardless of what other ingredients are present.

Figure 7:
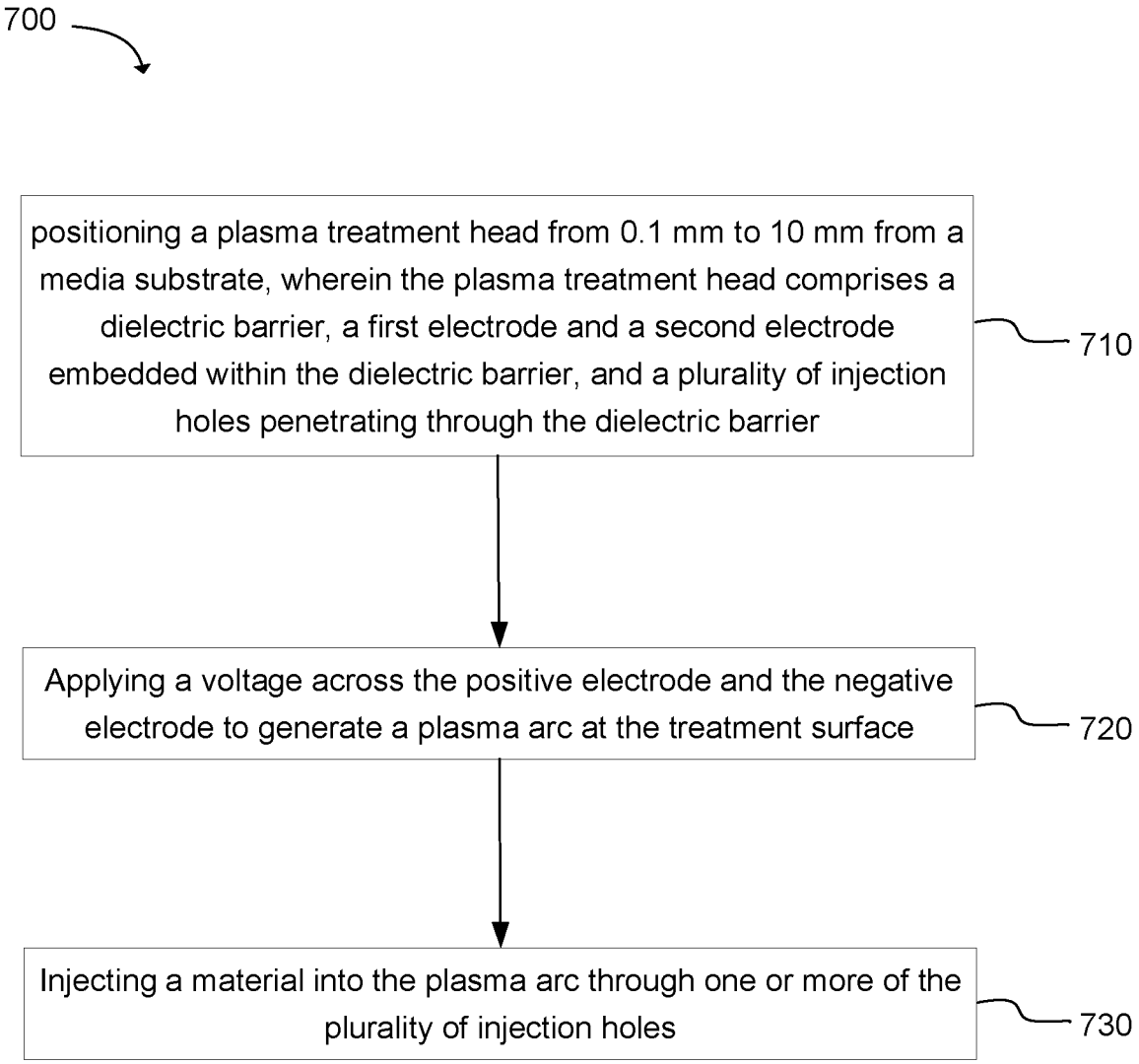
FIG. 7 is a flowchart illustrating an example method of plasma treating a media substrate in accordance with examples of the present disclosure.

The media substrate used in the printing system can be any of a wide variety of media substrates. In various further examples, the media substrate can be plain paper, photo paper, glossy paper, offset paper, coated paper, textile, polymeric films, rigid media, or combinations thereof. The present disclosure also includes methods of plasma treating media substrates. FIG. 7 shows one example of a method 700 of plasma treating a media substrate. The method includes positioning 710 a plasma treatment head from 0.1 mm to 10 mm from a media substrate, wherein the plasma treatment head comprises a dielectric barrier, a first electrode and a second electrode embedded within the dielectric barrier, and a plurality of injection holes penetrating through the dielectric barrier. In one example, the plasma treatment head can include a dielectric barrier in the form of a dielectric plate formed of a dielectric material having a treatment surface and an interior surface opposite of the treatment surface, the first electrode embedded within the dielectric barrier beneath the treatment surface, the second electrode embedded within the dielectric barrier beneath the treatment surface and spaced laterally apart from the first electrode. The plurality of injection holes can be located between the first electrode and second electrode. Additional steps can include applying 720 a potential difference across the first electrode and the second electrode to generate a plasma arc at the treatment surface; and injecting 730 a material into the plasma arc through one or more of the plurality of injection holes.

In some examples, the plasma treatment can be performed for a time period of 0.1 second to 20 seconds. In more specific examples, the time period can be 0.5 second to 10 seconds or 1 second to 5 seconds. As used herein, the time period of the plasma treatment refers to the amount of time that a treated portion of the media substrate is exposed to the plasma. In various examples, the media substrate may be in direct contact with the plasma arc or merely have the plasma arc passed over the media substrate. In the case of a web-fed printing system, the media substrate can constantly move past the plasma treatment head. Thus, the time period of the plasma treatment can be the time required for a point on the media substrate to travel across the length of the plasma generator. In examples where the printing system includes the plasma treatment head on a carriage, the plasma treatment head can either be held stationary over a portion of the media substrate for the plasma treatment time period, or the carriage can move at an appropriate speed so that each portion of the media substrate is plasma treated for the appropriate time period.

Generally, longer plasma treatment can provide better ink fixing properties to the media substrate when the plasma treatment head is used to pretreat the media substrate.

Similarly, longer plasma treatment can provide better durability of curable ink and/or a more durable overcoat layer when the plasma treatment head is used to post-treat the printed image. In further examples, the distance of the plasma generator from the media substrate can affect the time period required to achieve the desired properties. At greater distances, a longer time period may be required.

It is noted that, as used in this specification and the appended claims, the singular forms "a," "an," and "the" include plural referents unless the content clearly dictates otherwise.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

In this disclosure, "comprises," "comprising," "having," "includes," "including," and the like, and are generally interpreted to be open ended terms. The term "consisting of" is a closed term, and includes only the methods, compositions, components, steps, or the like specifically listed. "Consisting essentially of" or "consists essentially" or the like, when applied to methods, compositions, components, steps, or the like encompassed by the present disclosure, refers to elements like those disclosed herein, but which may contain additional composition components, method steps, etc., that do not materially affect the basic and novel characteristic(s) of the compositions, methods, etc., compared to those of the corresponding compositions, methods, etc., disclosed herein. When using an open ended term, like "comprising" or "including," it is understood that direct support should be afforded also to "consisting essentially of" language as well as "consisting of" language as if stated explicitly, and vice versa.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

Percentages, ratios, and parts refer to weight percentages, weight ratios, and parts by weight unless otherwise specified or otherwise clear from the surrounding context.

As a further note, in the present disclosure, it is noted that when discussing the printing systems, methods of plasma treating, and plasma treatment heads, each of these discussions can be considered applicable to each of these examples, whether or not they are explicitly discussed in the context of that example. Thus, for example, in discussing details about the printing system per se, such discussion also refers to the methods and the plasma treatment heads described herein, and vice versa.

While the disclosure has been described with reference to certain examples, various modifications, changes, omissions, and substitutions can be made without departing from the spirit of the disclosure. It is intended, therefore, that the disclosure be limited only by the scope of the following claims.

What is claimed is:

1. A plasma treatment head, comprising:

a dielectric barrier formed of a dielectric material having a treatment surface and an interior surface opposite of the treatment surface;

a first electrode embedded within the dielectric barrier beneath the treatment surface;

a second electrode embedded within the dielectric barrier beneath the treatment surface and spaced laterally apart from the first electrode, wherein the first electrode and the second electrode are located at an approximately uniform distance beneath the treatment surface, such that a voltage applied to the first electrode and the second electrode forms a plasma arc on the treatment surface; and a plurality of injection holes penetrating through the dielectric plate from the interior surface to the treatment surface, wherein the plurality of injection holes are located between the first electrode and second electrode.

2. The plasma treatment head of claim 1, further comprising an injection manifold in fluid communication with the plurality of injection holes at the interior surface.

3. The plasma treatment head of claim 1, wherein the first electrode and second electrode comprise a plurality of interdigitated fingers.

4. The plasma treatment head of claim 1, wherein the dielectric material is a ceramic.

5. The plasma treatment head of claim 1, further comprising a functional material reservoir in fluid communication with the plurality of injection holes at the interior surface.

6. The plasma treatment head of claim 5, wherein the functional material reservoir contains a fixer, monomer, polymer, crosslinking agent, or combinations thereof.

7. A printing system, comprising:

an inkjet print head to form a printed image on a media substrate; and a plasma treatment head positioned with respect to the inkjet print head to treat the media substrate before or after printing the printed image, wherein the plasma treatment head comprises:

a dielectric barrier formed of a dielectric material having a treatment surface and an interior surface opposite of the treatment surface, a first electrode embedded within the dielectric barrier beneath the treatment surface, a second electrode embedded within the dielectric barrier beneath the treatment surface and spaced laterally apart from the first electrode, and a plurality of injection holes penetrating through the dielectric plate from the interior surface to the treatment surface, wherein the plurality of injection holes are located between the first electrode and second electrode.

8. The printing system of claim 7, further comprising an injection manifold in fluid communication with the plurality of injection holes at the interior surface.

9. The printing system of claim 7, wherein the first electrode and second electrode comprise a plurality of interdigitated fingers.

10. The printing system of claim 7, wherein the dielectric material is a ceramic.

11. The printing system of claim 7, further comprising a functional material reservoir in fluid communication with the plurality of injection holes at the interior surface.

12. The printing system of claim 11, wherein the functional material reservoir contains a fixer, monomer, oligomer, polymer, crosslinking agent, or combinations thereof.

13. The printing system of claim 7, further comprising an ink reservoir in fluid communication with the inkjet print head, the ink reservoir comprising a pigment-based inkjet ink that is substantially devoid of photoinitiators.

14. A method of plasma treating a media substrate, comprising:

positioning a plasma treatment head from 0.1 mm to 10 mm from a media substrate, wherein the plasma treatment head comprises a dielectric barrier, a first electrode and a second electrode embedded within the dielectric barrier, and a plurality of injection holes penetrating through the dielectric barrier, wherein the first electrode and the second electrode are located at an approximately uniform distance beneath a treatment surface of the dielectric barrier;

applying a potential difference across the first electrode and the second electrode to generate a plasma arc at the treatment surface; and injecting a material into the plasma arc through one or more of the plurality of injection holes.

15. The method of plasma treating a media substrate, wherein the media substrate comprises a printed image formed of a pigment-based inkjet ink.

16. The plasma treatment head of claim 1, wherein a distance from the first electrode to the injection hole is greater than a distance from the first electrode to the treatment surface, and wherein a distance from the second electrode to the injection hole is greater than a distance from the second electrode to the treatment surface.

* * * * *